US009150292B2

(12) United States Patent
Ibsen et al.

(10) Patent No.: US 9,150,292 B2
(45) Date of Patent: Oct. 6, 2015

(54) INFLATABLE FLOATABLE UNIT

(75) Inventors: Christian Ibsen, Tønder (DK); Sinne Nielsen, Kolding (DK)

(73) Assignee: Viking Life-Saving Equipment A/S, Esberg (DK)

( * ) Notice: Subject to any disclaimer, the term of this patent is extended or adjusted under 35 U.S.C. 154(b) by 17 days.

(21) Appl. No.: 14/127,129

(22) PCT Filed: Jun. 15, 2012

(86) PCT No.: PCT/EP2012/061509

§ 371 (c)(1),
(2), (4) Date: Dec. 17, 2013

(87) PCT Pub. No.: WO2012/172081

PCT Pub. Date: Dec. 20, 2012

(65) Prior Publication Data

US 2014/0256197 A1 Sep. 11, 2014

(30) Foreign Application Priority Data

Jun. 17, 2011 (DK) ..... 2011 70310

(51) Int. Cl.
*B63C 9/04* (2006.01)
*B63B 7/08* (2006.01)
*B63B 35/58* (2006.01)

(52) U.S. Cl.
CPC . *B63C 9/04* (2013.01); *B63B 7/085* (2013.01); *B63B 35/58* (2013.01); *B63C 2009/042* (2013.01)

(58) Field of Classification Search
CPC ..... B63C 9/00; B63C 9/02; B63C 9/04; B63C 9/22; B63B 35/58; B63B 7/08; B63B 7/085; B63B 17/00
USPC ..... 441/39, 40
See application file for complete search history.

(56) References Cited

U.S. PATENT DOCUMENTS 5,421,757 A * 6/1995 Basiliere ..... 441/39
6,685,520 B1 * 2/2004 Wiggins ..... 441/40

FOREIGN PATENT DOCUMENTS

| | | | |
|---|---|---|---|
| EP | 1953080 | A1 | 8/2008 |
| FR | 2756809 | A1 | 6/1998 |
| GB | 791492 | A | 3/1958 |
| WO | 2008131763 | A1 | 11/2008 |
| WO | 2009127213 | A2 | 10/2009 |

OTHER PUBLICATIONS

International Searching Authority, International Search Report and Written Opinion issued in corresponding International Application No. PCT/EP2012/061509 dated Nov. 15, 2012, 24 pages.

* cited by examiner

*Primary Examiner* — Lars A Olson
(74) *Attorney, Agent, or Firm* — Wood, Herron & Evans, LLP

(57) ABSTRACT

The present invention relates to an inflatable floatable unit (2) comprising an inflatable flotation layer (21) comprising a plurality of inflatable floatation tubes (211); an inflatable structural layer comprising an inflatable outer tube defining a circumferential barrier, the inflatable structural layer being arranged substantially above the inflatable flotation layer; and a flooring element (23) provided between the inflatable flotation layer (21) and the inflatable structural tube layer (22), thereby defining a bottom of the inflatable floatable unit, wherein the inflatable structural layer further comprises a plurality of inflatable seating elements extending in a longitudinal direction in a protected area (224) enclosed by the inflatable outer tube element, and the inflatable floatable unit comprises a gangway element (24) extending in a direction transversal to the longitudinal direction of the inflatable seating elements, thereby defining a gangway.

23 Claims, 8 Drawing Sheets

INFLATABLE FLOATABLE UNIT

FIELD OF THE INVENTION

The present invention relates to an inflatable floatable unit comprising an inflatable flotation layer comprising a plurality of inflatable floatation tubes; an inflatable structural layer comprising an inflatable outer tube defining a circumferential barrier, the inflatable structural layer being arranged substantially above the inflatable flotation layer; and a flooring element provided between the inflatable flotation layer and the inflatable structural tube layer, thereby defining a bottom of the inflatable floatable unit.

BACKGROUND ART

Evacuation systems are a vital part of ships and other structures operating at, on or in water. In passenger ships, the evacuation systems are designed for a large number of passengers and occupy a great amount of space on board. Generally speaking, evacuation systems occupy space that could be utilised for passengers. Present evacuation systems often utilise a combination of rescue boats or tender boats and inflatable life rafts arranged around the ship, occupying a lot of space.

As many passengers, especially on board cruise ships, demand an external cabin with a view, a problem has arisen with evacuation system primarily mounted on the outside of the ship as these often block the view. A need for reducing the space occupied by evacuation systems has therefore arisen, especially a need for an evacuation system maximising the number of cabins with a sea view.

At the same time, the size of rescue boats or life rafts is constantly increasing to match the growing sizes of ships. When a large number of passengers have to be evacuated into one life raft, speed is a crucial factor. The evacuation process will always be subject to bottlenecks and the resulting accumulation of passengers at certain positions. It is therefore important that a certain flow in the evacuation process is achieved, and that different types on passengers can move relatively easily through the system to the correct seating position in the raft.

Further, the organisation and positioning of passengers in the rafts have become an important issue with the growing raft size. Traditionally, passengers have just been seated on the bottom of the rafts in an unstructured manner. However, a large number of passengers seated in an unstructured manner may occupy much more space than intended.

SUMMARY OF THE INVENTION

It is an object of the present invention to wholly or partly overcome the above disadvantages and drawbacks of the prior art. More specifically, it is an object to provide an improved evacuation system wherein passengers are evacuated in a safe, fast and intuitive manner from a ship or the like and into a seated position in an inflatable floatable structure.

The above objects, together with numerous other objects, advantages, and features, which will become evident from the below description, are accomplished by a solution in accordance with the present invention by an inflatable floatable unit comprising an inflatable flotation layer comprising a plurality of inflatable floatation tubes; an inflatable structural layer comprising an inflatable outer tube defining a circumferential barrier, the inflatable structural layer being arranged substantially above the inflatable flotation layer; and a flooring element provided between the inflatable flotation layer and the inflatable structural tube layer, thereby defining a bottom of the inflatable floatable unit; wherein the inflatable structural layer further comprises a plurality of inflatable seating elements extending in a longitudinal direction in a protected area enclosed by the inflatable outer tube element, and the inflatable floatable unit comprises a gangway element extending in a direction transversal to the longitudinal direction of the inflatable seating elements, thereby defining a gangway.

Hereby, a high capacity inflatable floatable unit is provided that may be embarked in a fast, structured and safe way. Those embarking the inflatable floatable unit may move unhindered along the gangway due to the gangway extending across the seating elements. Fast and easy access to the seating elements is therefore achieved. Further, the inflatable seating elements indicate where those embarked are to sit, and the inflatable seating elements aid in the organisation of people.

In one embodiment, the gangway element may be raised above the bottom of the inflatable floatable unit and extend over the inflatable seating elements.

Hereby, the gangway is suspended above sea level, which may provide a more stable walking path, and the inflatable seating elements may be constituted by continuous structures extending in the entire length or width of the inflatable floatable unit.

In another embodiment, opposite ends of the gangway element being secured to the inflatable outer tube and the gangway element may extend all the way across the protected area.

Hereby, it is possible to move fast and unhindered in a direction transversal to the inflatable seating elements and access any seating element without having to crawl over or straddle the seating elements.

Also, one end of the gangway element may be secured to the inflatable outer tube and the gangway element may extend at least partially across the protected area.

Moreover, part of the gangway may define a reception platform for receiving passengers embarking the inflatable floatable unit.

By the reception platform being part of the gangway raised above the bottom of the inflatable floatable unit, a suspended reception platform is achieved, whereby those embarking may land comfortably and safely in the inflatable floatable unit.

Also, the inflatable seating elements may be arranged in parallel to one another with a mutual distance of 40 to 125 cm.

Hereby, an appropriate relationship between the number of seating elements, i.e. the capacity of the inflatable floatable unit, and the ability of the passengers to move and to stay seated in a safe manner in the inflatable floatable unit is achieved.

In one embodiment, an inflatable flotation layer may comprise 8-12 inflatable floatation tubes, and the inflatable structural layer may comprise 8-12 inflatable seating elements.

Further, the seating elements may be adapted for sitting astride with one leg on either side by the seating elements having a width (W) in the range from 30 to 70 cm.

In addition, a top surface of the inflatable seating elements may be convex.

Said inflatable seating elements may be constituted by tubular structures.

In one embodiment, the inflatable seating elements may have an internal pressure in the range of 150 to 300 millibar.

In another embodiment, the seating elements may comprise a plurality of handles extending from a surface thereof, whereby people sitting astride the sitting elements can grab one or more handles.

Furthermore, the seating elements may comprise markings indicating where people are supposed to sit and motivating people to move to the next available seat.

Additionally, the gangway element may extend in a continuous manner in a substantially horizontal direction, thereby constituting a substantially planar path.

The gangway element may be supported by the seating elements.

The gangway element may also be supported by additional inflatable tubes extending in a direction transverse to that of the seating elements.

In one embodiment, the material constituting the gangway element may be in tension during use, whereby the stability of the gangway element is increased, and the gangway element contributes to the structural integrity of the inflatable floatable unit.

In another embodiment, the gangway element may be an inflatable element or structure.

In a third embodiment, the gangway element may extend in a plane that is tangent to the seating elements.

In yet another embodiment, the gangway element may extend between the top of two adjacent seating elements.

Also, the gangway element may extend between the top of a seating element and the top of the inflatable outer tube.

Furthermore, the gangway element may provide part of a steering platform for a person steering the inflatable floatable unit.

Moreover, the width of a gangway element and/or the number of gangway elements may be changed during operation of the inflatable floatable unit.

The inflatable floatable unit may comprise multiple gangway elements extending in the same or multiple directions across and along the inflatable seating elements.

Moreover, at least two gangway elements may be arranged in the inflatable floatable unit, the two gangway elements being positioned across the seating elements so that the protected area is divided into three areas having substantially the same size.

Further, the gangway element may be releasably attached to the inflatable floatable unit.

Also, the gangway element may be securely attached to the inflatable floatable unit.

In one embodiment, the seating elements may provide structural rigidity to the inflatable floatable unit.

Furthermore, a material constituting the gangway element may be in tension during use, whereby the stability of the gangway element is increased, and the gangway element contributes to the structural integrity of the inflatable floatable unit.

Said seating elements may contribute to the buoyancy of the inflatable floatable unit as a backup to the buoyancy of the inflatable flotation layer. Hereby, in the unlikely event that the buoyancy provided by the inflatable flotation layer is reduced, the inflatable seating elements may secure the overall buoyancy of the inflatable floatable unit.

Moreover, a space may be provided between at least one end of an inflatable seating element and the inflatable outer tube, whereby passengers moving in a direction transverse to the direction of the inflatable seating element do not have to straddle the inflatable seating element.

In addition, the seating elements may be releasably attached to the flooring element of the inflatable floatable unit, e.g. by means of zippers, whereby the layout of the protected area may be varied according to specific needs.

The inflatable floatable unit according to the present invention may further comprise a first inflation system for inflating the inflatable flotation layer and a second inflation system for inflating the inflatable seating elements.

Also, the inflatable floatable unit according to the present invention may further comprise at least one on-board compressor constituting part of the first and/or the second inflation system.

In one embodiment, each of the seating elements may be comprised by a plurality of separate chambers fluidly connected by check valves.

In another embodiment, one or more shell elements may be connected with the inflatable structural layer and/or the inflatable flotation layer.

In one embodiment, the shell elements may be connected to the inflatable outer tubes by means of zippers.

The present invention also relates to an evacuation system comprising at least one inflatable floatable unit according to any of the preceding claims and one or more chutes and/or slides extending from a vessel to the at least one inflatable floatable unit.

Said evacuation system may comprise two inflatable floatable units positioned side by side and being releasably connected with each other.

In one embodiment, the gangway may extend from a side of one of the inflatable floatable units across both inflatable floatable units to a side of the other inflatable floatable unit.

Hereby, passengers may easily move from one inflatable floatable unit to another.

I another embodiment, the gangway element may incline at least in the section of the gangway element where the exit of the chute or the slide is positioned.

The present invention furthermore relates to use of a plurality of inflatable seating elements according to the invention, comprised in a life raft for sitting astride, wherein the passengers sit astride on each of the inflatable seating elements with one leg on either side of the inflatable seating element, whereby the passengers are isolated from a bottom of the inflatable floatable unit.

Finally, the present invention relates to a vessel comprising an evacuation system according to any of the preceding claims.

In one embodiment, the vessel may be a vessel carrying a large number of people on board, such as a passenger ship, a ferry, a cruise ship, a military vessel, etc.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
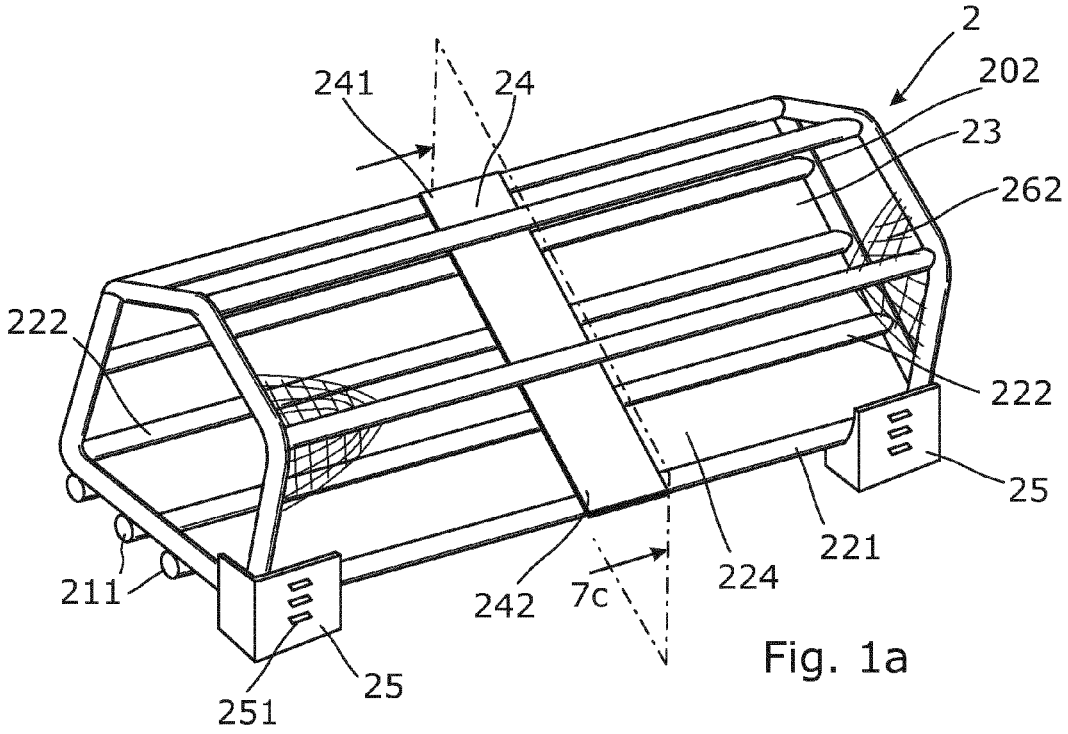
FIGS. 1*a*-1*c* show schematically an inflatable floatable unit.
Figure 1B:
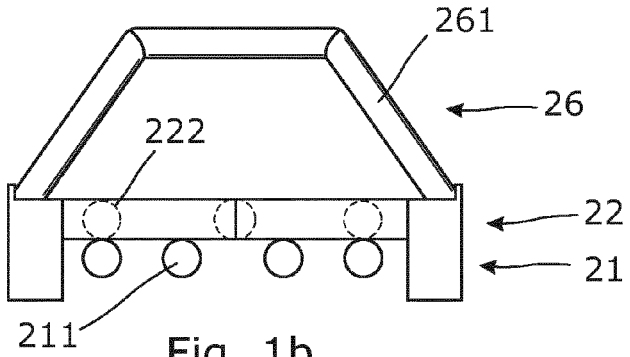
Figure 1C:
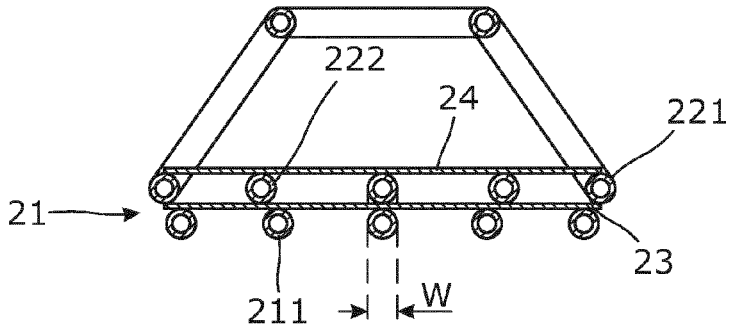

FIG. 1 shows an inflatable floatable unit 2 in an inflated condition. The inflatable floatable unit 2 comprises an inflatable flotation layer 21 arranged towards the lower part of the inflatable floatable unit when the inflatable floatable unit is regarded in a substantially upright position, as shown in FIG. 1*a*. The inflatable flotation layer 21 comprises a plurality of inflatable flotation tubes 211 extending along the inflatable floatable unit. The inflatable flotation layer 21 substantially provides the buoyancy keeping the inflatable floatable unit floating in the desired position.

Above the inflatable floatation layer, an inflatable structural layer 22 is provided. The inflatable structural layer comprises an inflatable outer tube 221 defining a circumferential barrier. The circumferential barrier in turn defines a protected area 224 enclosed by the inflatable outer tube element. A bottom part of the inflatable outer tube 221 is connected with a top part of each of the inflatable flotation tubes 211. The inflatable outer tube 221 and the inflatable flotation tubes 211 may be connected directly or by means of an intermediate flooring 23 provided between the tubes, as further described below. The inflatable outer tube 221 and the inflatable flotation tubes 211 may be glued or welded together or be connected by other means, such as zippers. The inflatable structural layer further comprises a plurality of inflatable seating elements 222 extending in a longitudinal direction in the protected area 224. The inflatable seating elements 222 are constituted by inflatable tubes having a width W making the inflatable seating elements suitable for sitting astride with one leg on either side. In an alternative embodiment, the inflatable seating elements 222 may be comprised by non-tubular elements, e.g. elements only having rounded-off corners or a convex top surface. In the shown embodiment, opposite ends 241, 242 of the inflatable seating elements 222 are connected with the outer tube element and thus extend across the entire protected area. In an alternative embodiment, the inflatable seating elements 222 may be comprised by shorter inflatable seating elements spanning only part of the protected area. Further, the inflatable floatation layer and the inflatable seating elements 222 may contribute to the buoyancy of the inflatable floatable unit as a backup to the buoyancy provided by the inflatable flotation layer. Thus, in the unlikely event that the buoyancy provided by the inflatable flotation layer is reduced, the inflatable seating elements may secure the overall buoyancy of the inflatable floatable unit.

It is to be understood by those skilled in the art that the number of inflatable flotation tubes 211 and/or the number of inflatable seating elements 222, both higher and lower than that specified, is possible and is considered to be within the scope of the present invention. The inflatable flotation layer may thus comprise 8-12 floatation tubes, preferably 10 flotation tubes, and the inflatable structural layer may comprise 8-12 floatation tubes, preferably 10 flotation tubes, A flooring element 23 is provided between the inflatable flotation layer 21 and the inflatable structural tube layer, thereby defining a bottom of the inflatable floatable unit. When regarded in an upright position, as shown in FIG. 1*a*, the flooring element is substantially planar and extends in a horizontal plane. The inflatable outer tube is positioned above the flooring element and the inflatable flotation tubes below the flooring element. When the inflatable floatable unit is deployed on water and loaded, the bottom of inflatable floatable unit is at a level which is substantially equal to the sea level. Preferably, the bottom of inflatable floatable unit is at a level raised above the sea level.

The inflatable floatable unit further comprises a gangway element 24 extending in a direction transversal to the longitudinal direction of the inflatable seating elements. As shown in FIG. 1*a*, the gangway element 24 extends from one side of the inflatable floatable unit to the other and thereby defines a gangway across the inflatable seating elements and the inflatable floatable unit. Opposite ends of the gangway element 24 are secured to the inflatable outer tube. The gangway element 24 extends in a continuous manner in a substantially horizontal direction, thereby providing a substantially planar path in a level above or tangent to the inflatable seating elements. The gangway element 24 is in tension when the inflatable floatable unit is in the inflated condition, whereby the stability of the gangway element is increased. By the gangway element further being supported by the seating elements, a substantially stabile walking path is provided. Further, the gangway element 24 functions as a structural element of the inflatable floatable unit. By the gangway element 24 being secured to the inflatable outer tube and extending across the inflatable floatable unit, the gangway element prevents the sides of the inflatable floatable unit from moving too far apart and thereby contributes to the structural integrity of the inflatable floatable unit. Further, the gangway element 24 may be positioned in a substantially centre part of the inflatable floatable unit or towards the bow 201 or stern 202 of the inflatable floatable unit when seen in the longitudinal direction.

The gangway element 24 provides a path for the passengers to walk on when embarking the inflatable floatable unit. By providing a walking path in a level above the seating elements, the passengers do not have to scale, straddle or climb across the seating elements. Hereby, easy access is provided to most of the inflatable floatable unit, and less agile passengers have a better chance of moving into the correct seating location when entering the inflatable floatable unit. In the shown embodiment, only one gangway is shown. The inflatable floatable unit may, however, comprise multiple gangway elements 24 extending across the inflatable floatable unit. Alternatively, the gangway elements may extend in various directions across or along the inflatable seating elements. In one embodiment, the one or more gangway elements may be releasably attached to the inflatable floatable unit, e.g. by means of zippers. Hereby, the layout of the one or more gangway elements 24 can be changed, or the one or more gangway elements can be removed from the protected area of the inflatable floatable unit.

Figure 9:
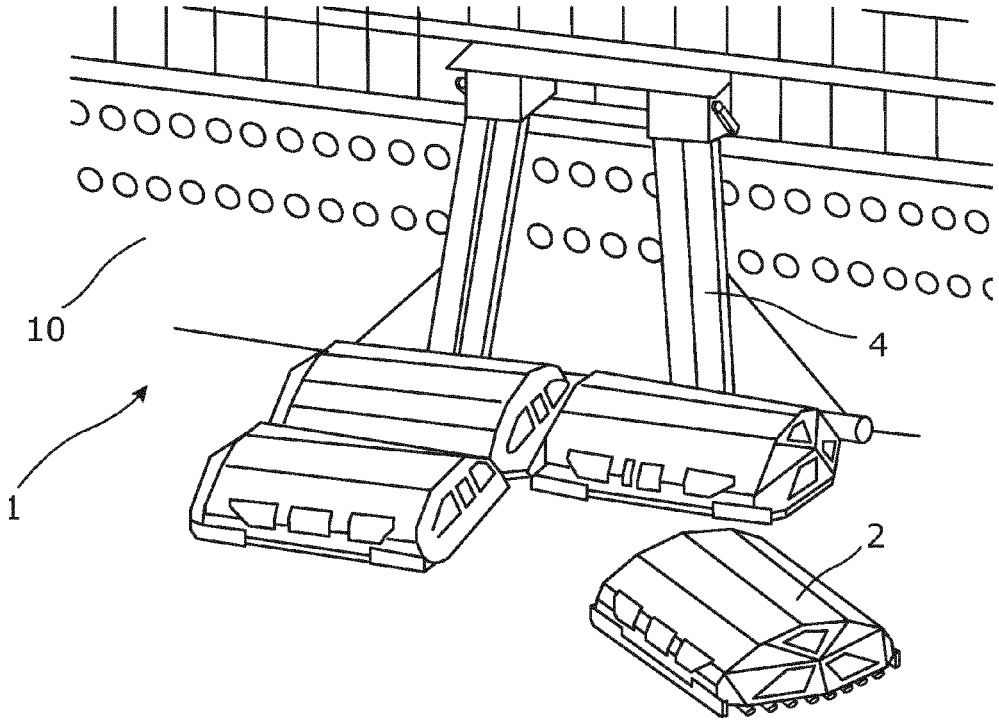
FIG. 9 shows an inflatable floatable unit sailing to a safe position.

FIGS. 1*a* and 1*b* show shell elements 25 attached at the corners of the inflatable floatable unit. The shell elements 25 are attached to the inflatable outer tube, and the shells together constitute a protective shell or container for the inflatable floatable unit before deployment. The shell elements 25 may be connected to the inflatable outer tubes by means of zippers or by other means known to the person skilled in the art. The shell elements comprise built-in steps 251 for entering the inflatable floatable unit from the sea in the event that passengers are rescued from the sea. Each of the shells also comprises a battery pack and an electric motor driving a propeller mounted on a shaft. When the inflatable floatable unit is deployed and inflated, the propeller is automatically lowered from the shell element 25 and into a position below the inflatable floatable unit. The electric motor and associated propeller provide propulsion for maneuvering the inflatable floatable unit to a safe position away from a ship, as shown in FIG. 9. The shell elements 25 further comprise space for storing supplies, such as emergency packages containing food, water, first aid equipment, medication, etc. The shell elements 25 may also be used to store various equipment, such as a flares, repair kits, fishing equipment, etc.

To shield the protected area 224, e.g. from wind, splashes or rain, the inflatable floatable unit comprises a top structure constituted by inflatable tubes 261 and a protective sheet 262. The inflatable tubes 261 provide structural rigidity to the top structure, and the protective sheet is arranged on the outside of the inflatable tubes to cover the protected area. By incorporating transparent areas in the protective sheet, windows are provided in the top structure.

An inflatable floatable unit according to an embodiment of the present invention may have a capacity of up to 300 passengers. In such inflatable floatable units, access to and from the inflatable floatable unit and ventilation of air inside the inflatable floatable unit are of considerable importance. Therefore, a plurality of zippers are provided in the protective sheet 262, whereby sections of the protective sheet may be opened or removed to control ventilation of air and/or provide additional openings for passengers.

Figure 7:
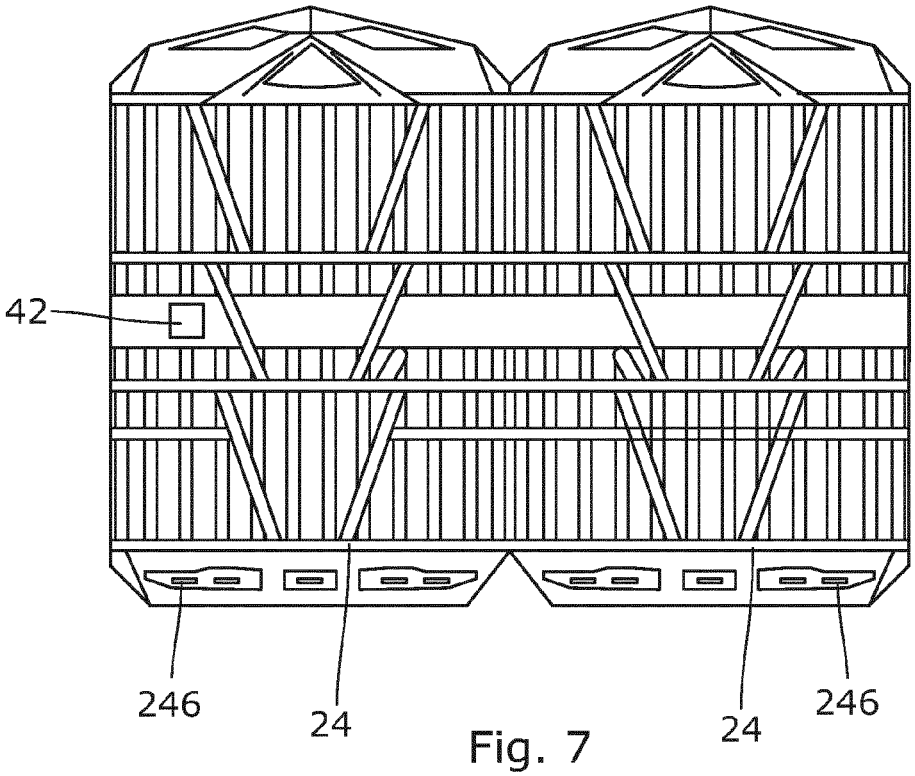
FIG. 7 shows an overview of two inflatable floatable units.
Figure 8A:
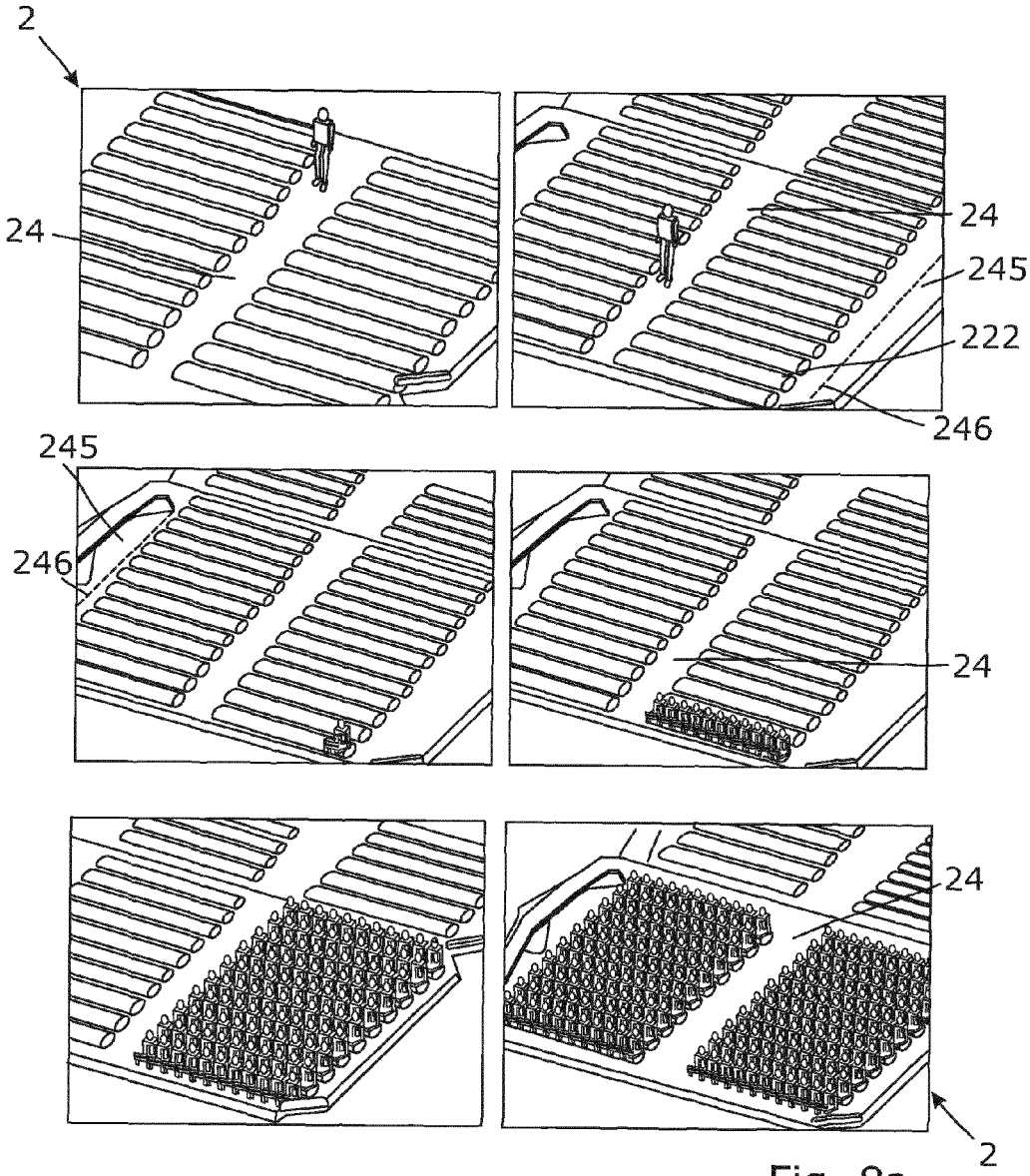
FIG. 8*a* shows how passengers move and are seated in two inflatable floatable units.

Further, in one embodiment, the inflatable floatable unit comprises platform elements 245 extending across the inflatable seating elements in the bow 201 and the stern 202 of the inflatable floatable unit. The platform elements are shown in FIG. 8*a* and may be constructed similarly to the gangway elements and arranged on top of the seating elements. Hereby, the platform elements provide a substantially planar surface and may facilitate movement across the inflatable floatable unit and between the seating elements. Further, a plurality of apertures 246 are provided in the platform elements 245 in spaces between the inflatable floatation tubes, as shown in FIGS. 7 and 8*a*. The apertures 246 are provided with zippers, whereby they can be opened and closed, and the apertures may e.g. be used for air ventilation inside the inflatable floatable unit. If the apertures 246 are left open and the inflatable floatable unit moved, outside air may be forced through the apertures and into the inflatable floatable unit. The apertures 246 may also be used for other purposes as they provide direct access from the inside of the inflatable floatable unit to the surface of the sea. The apertures may for example be used for fishing, dumping garbage, human waste, etc. By the apertures 246 being provided in the substantially planar surface of the platform elements 245, the apertures may provide part of a toilet facility whereby passengers can sit on the platform element 245 and defecate and urinate directly through the apertures 246 and into the sea. The apertures 246 may also be used for passengers vomiting. In another embodiment, the apertures may be provided directly in the flooring element of the inflatable floatable unit.

The inflatable floatable unit is inflated using an inflation system comprising compressed gas, such as nitrogen or carbon dioxide. The inflation system comprises a number of gas cylinders in fluid communication with the plurality of inflatable parts of the inflatable floatable unit. During deployment of the inflatable floatable unit, gas from the gas cylinders is released to inflate the inflatable floatable unit.

In an alternative embodiment the inflatable floatable unit is inflated by two separate inflation systems—a first inflation system for inflating the inflatable flotation layer and a second inflation system for inflating the inflatable seating elements. The first inflation system is based on compressed gas, such as nitrogen or carbon dioxide. For the first inflation system, the inflatable floatable unit comprises a number of gas cylinders in fluid communication with the plurality of inflatable flotation tubes 211 extending along the inflatable floatable unit. During deployment of the inflatable floatable unit, gas from the gas cylinders is released into the inflatable flotation tubes 211 as a first step of the inflation process. Hereby, a floating base is provided in a fast and reliable way. As a second step of the inflation process, the second inflation system is activated. The second inflation system is based on compressors provided in the shell elements and driven by the battery pack. The second inflation system inflates the inflatable structural layer 22 and the inflatable tubes 261 of the top structure. By the second inflation system being driven by the compressors, the amount of compressed gas, i.e. the number of gas cylinders, required to inflate the inflatable floatable unit is reduced. The second inflation system may inflate the inflatable structural layer 22 and the top structure of the inflatable floatable unit during deployment and/or embarkment of the inflatable floatable unit, due to the first inflation system having inflated the inflatable flotation tubes. The compressors may also be used for continuous inflation of at least part of the inflatable floatable unit, e.g. if the inflatable floatable unit loses pressure or if the pressure in specific inflatable tubes or elements have to be adjusted. Alternatively, the inflatable floatable unit may be provided with one or more manually actuated pumps for inflating the inflatable floatable unit in case of loss of pressure. In an alternative embodiment, the second inflation system may, however, also be based on compressed gas, e.g. if a faster inflation rate is required.

The inflatable tubes and elements are manufactured from a polymeric material, such as natural rubber (NR), polyurethane (PU), thermoplastic polyurethane (TPU), butyl rubber (BR), polyvinylchloride (PVC), polychloroprene (CR), polyethylene (PE), or a combination thereof.

Figure 2:
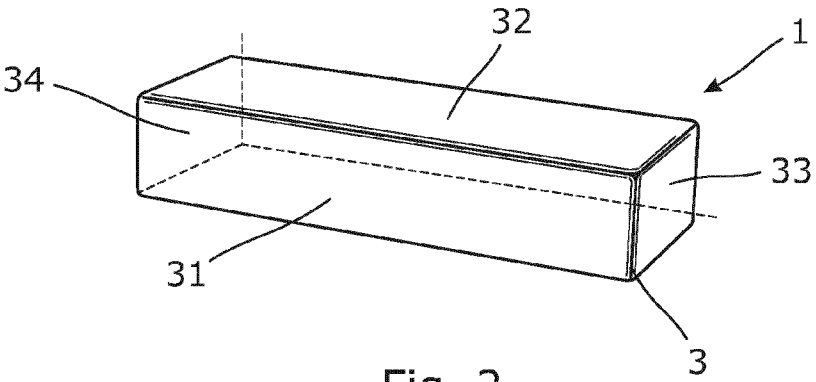
FIG. 2 shows an evacuation system comprised in a system container.
Figure 3:
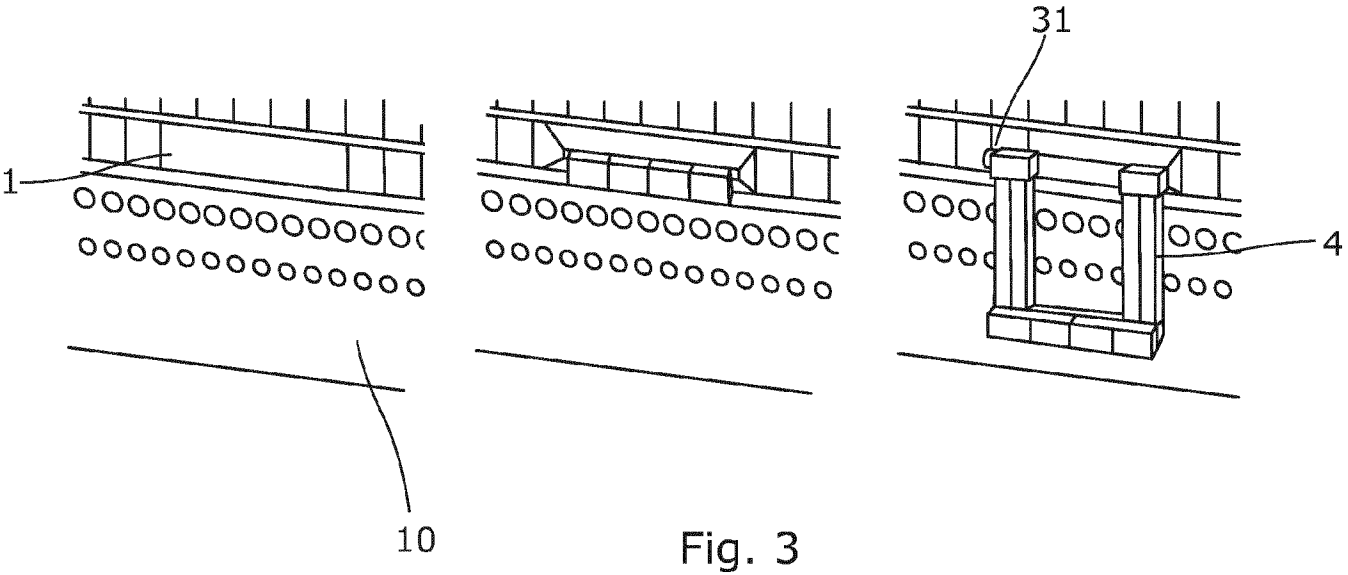
FIG. 3 shows the evacuation system installed on a ship, the evacuation system being deployed.
Figure 4:
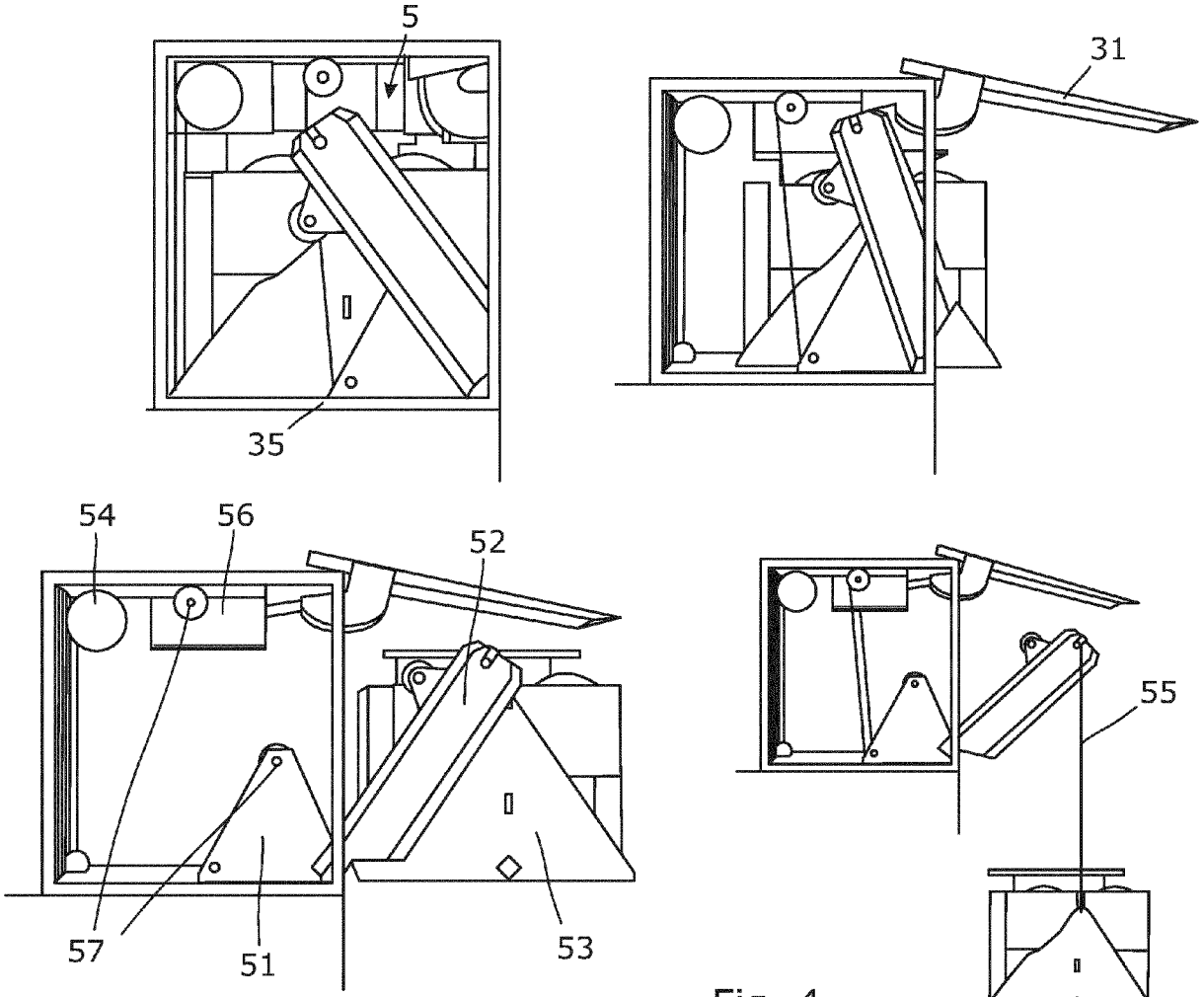
FIG. 4 shows a deployment mechanism.
Figure 5:
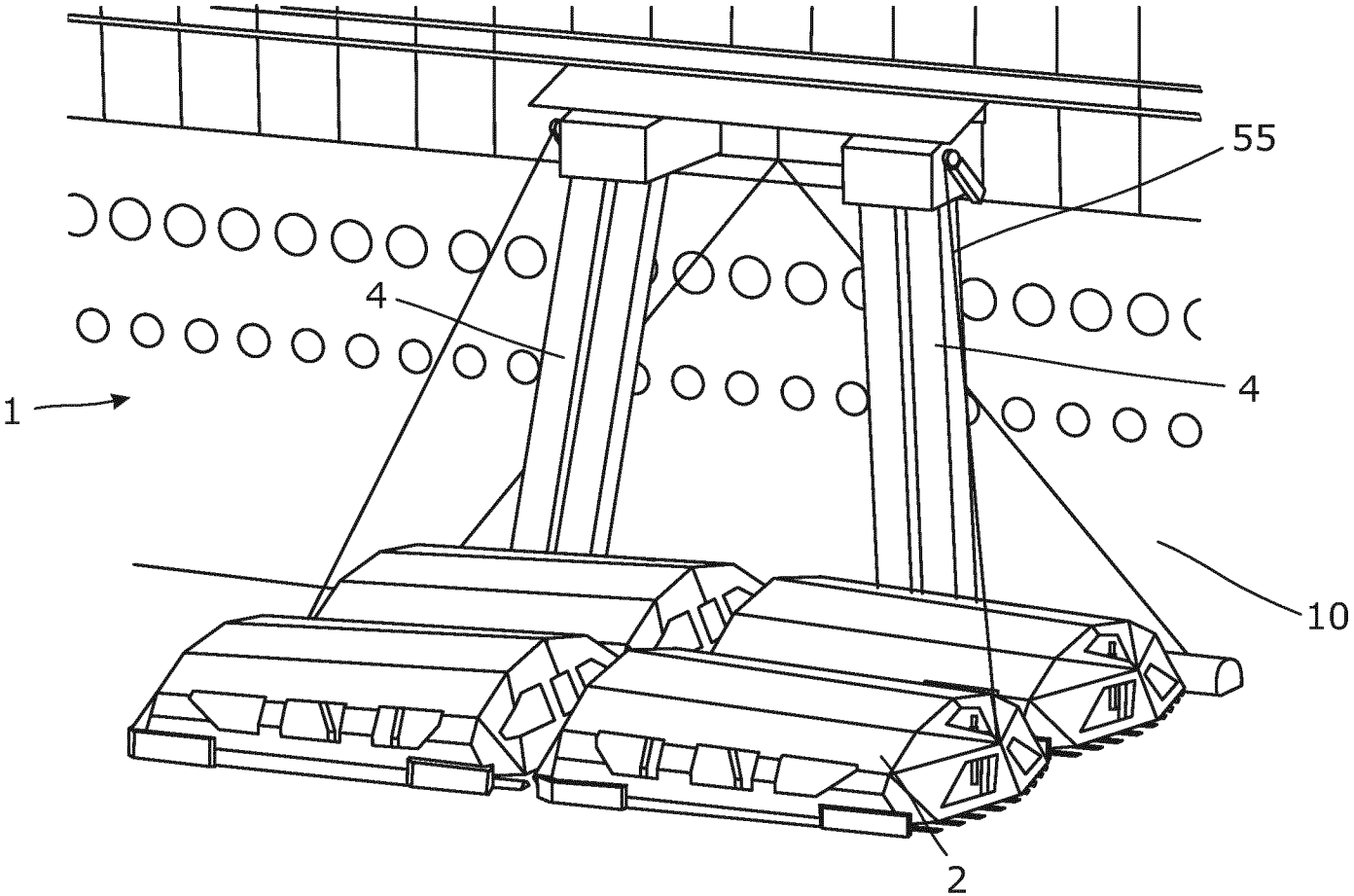
FIG. 5 shows the evacuation system in a deployed position comprising four inflatable floatable units.
Figure 6:
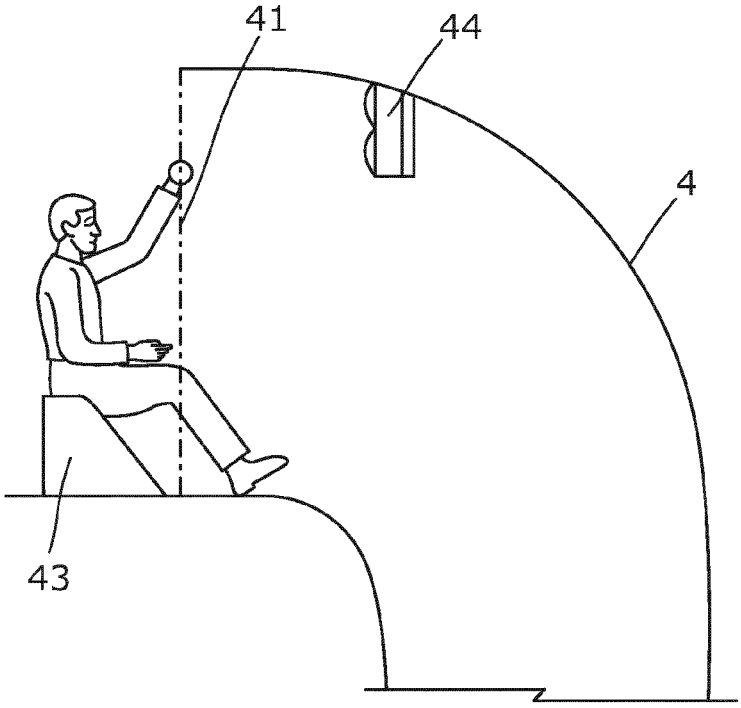
FIG. 6 shows a passenger launch ramp arranged at the entrance of a chute.

The inflatable floatable unit is part of an evacuation system comprising at least one inflatable floatable unit and one or more chutes 4, as shown in FIG. 5. In an alternative embodiment, the chute(s) may be substituted with slides depending on the access conditions of the inflatable floatable unit. The general concept of chutes and slides are standard life saving equipment, and the construction and functionality of such are considered to be known by the person skilled in the art. A detailed description of the construction of the chutes utilised is therefore not incorporated in this description. In the embodiment shown in FIGS. 2-5, the evacuation system comprises four inflatable floatable units and four evacuation chutes. FIG. 2 shows an evacuation system contained in a system container 3 having a front side 31 and a back side 32. During installation of the evacuation system, the entire system container is mounted on a ship or similar structure on, at or in water. As shown in FIG. 3, the system container may be installed in the space between two decks of a ship. By the evacuation system being contained in a system container, the system is enclosed and hidden and is thus protected against hard weather and everyday cleaning. Further, the system requires a minimum of maintenance.

The evacuation system is self-contained and comprises an integrated deployment system, as shown in FIG. 4. The deployment system will be described in the following in parallel with the description of the actual deployment of the evacuation system. The deployment will be described with reference to a ship, but it may in fact be used in connection with any structure on, at or in water.

When the evacuation system is to be deployed e.g. in an emergency situation, the evacuation system is activated by the crew or another person on the ship. When activated, the front side 31 of the system container opens. Inside the system container, the inflatable floatable unit is arranged on a lifting platform 53 positioned on a bottom 31 of the system container. When the front side 31 is open, the lifting platform is raised above the bottom of the system container and moved substantially linearly to a position outside the system container by means of a crane arm 52 pivotally mounted to a crane base 51, a winch 54 connected to a wire 55, a number of pulleys 57 and an actuator 56. While the winch raises the lifting platform by pulling the wire, the actuator pushes the load in a linear direction out of the system container. The mechanism constituted by the pivotally mounted crane arm, the pulleys and the wire causes the lifting platform to move in a substantially linearly direction above the bottom of the system container.

From the position outside the system container, the lifting platform is lowered in a controlled descend towards the surface of the sea, as shown in FIG. 3.

When entering the water, inflation is activated and the inflatable floatable units are inflated. Adjacent inflatable floatable units are connected with each other via the shell elements comprising releasable mechanical fastening means. The chutes 4 contained in the evacuation system extend from the system container to the two inflatable floatable units closest to the ship. The embodiment shown in FIG. 5 comprises four chutes, but any number of chutes may be used. In an alternative embodiment, the chutes may extend from the system container to each of the inflatable floatable units. When the inflatable floatable units are positioned along the side of the ship, the wires 55 are used to control the position of the inflatable floatable units.

To embark the inflatable floatable units, the passengers enter the system container through openings in the back side 32 and/or the sides 33 thereof. When mounted on a ship, the system container may be an integral part of the ship design and equipped with regular doors marked as emergency exits. In the system container, an entrance 41 to each of the chutes is provided. Each of the chutes is equipped with a launch ramp 43 to ensure that the passengers enter the chute as safely and correctly as possible. The next passenger to enter the chute is positioned on the launch ramp and awaits a go sign before entering the chute. The go sign may be a traffic light 44, a sound signal, etc. Motion sensors are provided in the chute to monitor passengers going through the chute and reduce the risk of passengers colliding. When the go sign is received, the passenger travels through the chute from the ship to the inflatable floatable unit. At the inflatable floatable unit, the passenger arrives directly on the gangway at a reception platform 42 defined by the gangway element, as shown in FIG. 7. The reception platform is raised above the bottom of the inflatable floatable unit and provides a safe landing zone for those embarking. Subsequently, the passenger moves away from the reception platform via the gangway. Passengers may thus move directly from the interior of the ship to the interior of the inflatable floatable units without being exposed to the elements of nature.

FIG. 7 shows two inflatable floatable units arranged side by side with the gangway extending across both inflatable floatable units. After exiting the chutes, the passengers move along the gangway to the next row of seating elements to be filled. By the gangway extending across both inflatable floatable units, the passengers may move into the inflatable floatable units next to the inflatable floatable units in which the exit of the chutes were located. At the same time, the substantially planar gangway provides a walking path that is relatively easy and fast to use. As described earlier, each of the inflatable floatable units may comprise multiple gangways providing access to different parts of the inflatable floatable units. Other than easing the movement of passengers, the gangway element provides a suitable space for the crew to move around in the inflatable floatable units. When the inflatable floatable unit is filled with passengers, the gangway may also provide the crew with a better overview of the crowd and inflatable floatable unit.

The gangway may be designed to support the distribution of passengers in an intuitive way. The gangway and/or the reception platform may incline near the chute outlet to urge passengers to move away from the chute outlet. The gangway may also be equipped with markings guiding passengers in the right direction to fill the inflatable floatable units as safely and effectively as possible. According to plan, the inflatable floatable units are to be filled from the back towards the outlet of the chutes, meaning that the first passenger to enter the inflatable floatable units is supposed to move to the corner of the inflatable floatable unit the farthest away from the chute outlet. FIG. 8*a* illustrates passengers entering the inflatable floatable units and how the outermost inflatable floatable unit is filled.

Figure 8B:
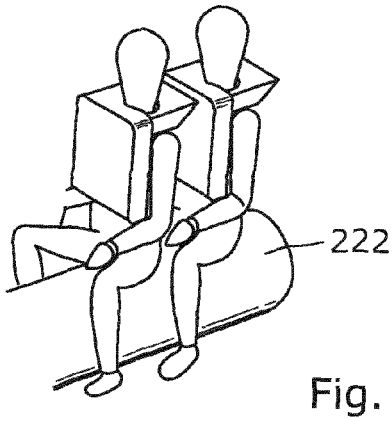
FIG. 8*b* shows passengers sitting astride on an inflatable seating element.

The inflatable seating elements are adapted for sitting astride, as shown in FIG. 8*b*. By the passenger sitting astride and facing the stern of the inflatable floatable unit, a suitable seating position is obtained. The passengers are in a relatively stable but dynamic seating position in which they are capable of following the movement of the inflatable floatable unit. When sitting on the inflatable seating elements, the passengers are isolated from the bottom of the inflatable floatable unit and are in close contact with other passengers to reduce the risk of hypothermia. Further, the inflatable seating elements may be equipped with a plurality of handles for the passengers to hold on to. The inflatable seating elements may also comprise markings indicating where people are supposed to sit, urging people to move to the next available seat. Such markings may be in the form of short text messages, arrows, colouring, etc.

When the passengers have embarked, the inflatable floatable units are released from the evacuation system one by one, as shown in FIG. 9. The inflatable floatable units positioned the farthest away from the side of the ship are filled first and are also released first. Each of the inflatable floatable units is operated independently of the evacuation system, and when released, they sail to a safe position a distance away from the ship. Each of the inflatable floatable units may be maneuvering around by means of the on board propulsion system while waiting for rescue.

Figure 10:
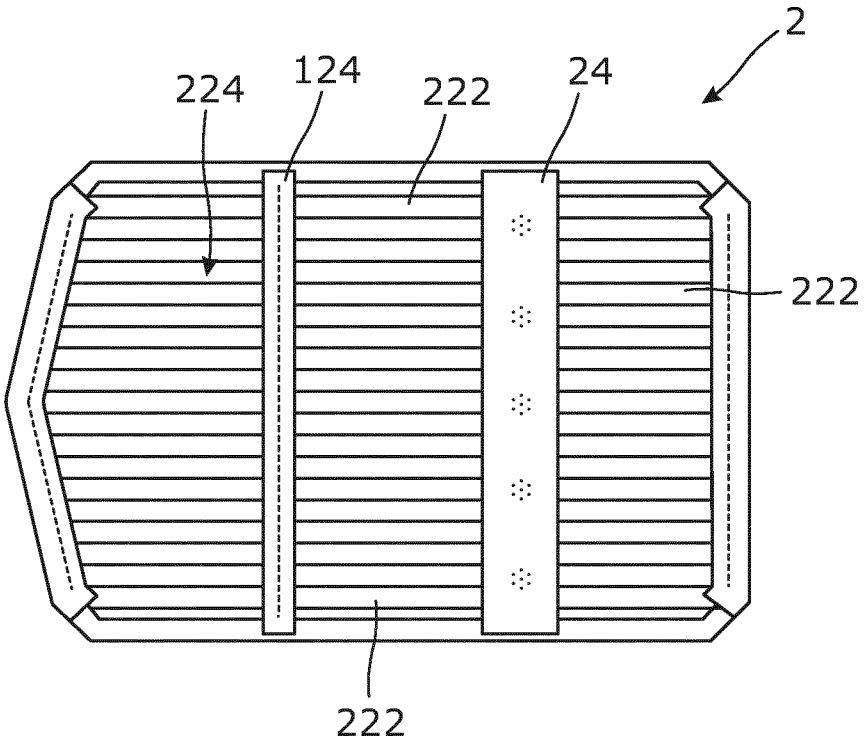
FIG. 10 shows an inflatable floatable unit having two gangway elements in a top view.

FIG. 10 shows another inflatable floatable unit 2 comprising a plurality of inflatable seating elements 222 extending in a longitudinal direction in the protected area 224 enclosed by the inflatable outer tube element. The inflatable floatable unit 2 comprises a first gangway element 24 extending in a direction transversal to the longitudinal direction of the inflatable seating elements 222, thereby defining a first gangway. A second gangway element 124 also extends in a direction transversal to the longitudinal direction of the inflatable seating elements 222, thereby defining a second gangway. The two gangway elements 24, 124 are positioned across the seating elements 222 so that the protected area 224 is divided into three areas having substantially the same size.

The first gangway element 24 has a width which is larger than a width of the second gangway element 124. The first gangway element 24 may for instance mainly be used as embarking area for chutes or slides. The second gangway element 124 may be used for facilitating passage and movement of the passengers and crew members in the inflatable floatable unit 2, and for minimising the claustrophobic effect of so many people being together in a small space. Furthermore, the second gangway element 124 provide more space and room for injured persons and small children who may lay on the second gangway element 124.

Additionally, openings to the exterior of the inflatable floatable unit may be arranged at the ends of the second gangway element 124, which facilitates rescuing of persons who have failed into the water. This is due to the fact that there will be additional openings for pulling the persons onboard and assisting and guiding them to a free seat on the seating elements 222. Furthermore, the openings may enhance the overall air ventilation in the unit 2.

Moreover, by having several gangway elements, it is possible to position the gangway element intended for the main embarkment closer to one of the ends of the inflatable floatable unit so that the chute(s) and/or slide(s) may have a substantially vertical extension. In this way, it is avoided that the chutes and slides also have an inclined extension in a longitudinal direction of the inflatable floatable unit. Hereby, it is obtained that the persons being evacuated through the chutes or slides will experience a more smooth decent than if the chutes or slides were inclined. By an inflatable floatable unit is meant any kind of inflatable float, raft, life raft, boat, vessel or craft capable of operating independently. The inflatable floatable unit may be fully inflatable or comprise a combination of inflatable and rigid elements.

Although the invention has been described in the above in connection with preferred embodiments of the invention, it will be evident for a person skilled in the art that several modifications are conceivable without departing from the invention as defined by the following claims.

The invention claimed is:

1. An inflatable floatable unit comprising:

an inflatable flotation layer comprising a plurality of inflatable floatation tubes;

an inflatable structural layer comprising an inflatable outer tube defining a circumferential barrier, the inflatable structural layer being arranged substantially above the inflatable flotation layer; and a flooring element provided between the inflatable flotation layer and the inflatable structural tube layer, thereby defining a bottom of the inflatable floatable unit; wherein the inflatable structural layer further comprises a plurality of inflatable seating elements extending in a longitudinal direction in a protected area enclosed by the inflatable outer tube element, and the inflatable floatable unit comprises a gangway element extending in a direction transversal to the longitudinal direction of the inflatable seating elements, thereby defining a gangway, wherein the gangway extends across at least one of the inflatable seating elements.

2. The inflatable floatable unit according to claim 1, wherein the gangway element is raised above the bottom of the inflatable floatable unit and extends over the inflatable seating elements.

3. The inflatable floatable unit according to claim 1, wherein opposite ends of the gangway element are secured to the inflatable outer tube and the gangway element extends all the way across the protected area.

4. The inflatable floatable unit according to claim 1, wherein part of the gangway defines a reception platform for receiving passengers embarking the inflatable floatable unit.

5. The inflatable floatable unit according to claim 1, wherein the seating elements are adapted for sitting astride with one leg on either side by the seating elements having a width in the range from 30 to 70 cm.

6. The inflatable floatable unit according to claim 1, wherein the gangway element extends in a continuous manner in a substantially horizontal direction, thereby constituting a substantially planar path.

7. The inflatable floatable unit according to claim 1, wherein the gangway element is supported by the seating elements.

8. The inflatable floatable unit according to claim 7, wherein the gangway element is also supported by additional inflatable tubes extending in a direction transverse to that of the seating elements.

9. The inflatable floatable unit according to claim 1, wherein the seating elements provide structural rigidity to the inflatable floatable unit.

10. The inflatable floatable unit according to claim 1, wherein a material constituting the gangway element is in tension during use, whereby the stability of the gangway element is increased, and the gangway element contributes to the structural integrity of the inflatable floatable unit.

11. The inflatable floatable unit according to claim 1, wherein the gangway element is an inflatable element or structure.

12. The inflatable floatable unit according to claim 1, wherein the gangway element extends in a plane that is tangent to the seating elements.

13. The inflatable floatable unit according to claim 1, wherein the gangway element extends between the top of two adjacent seating elements.

14. The inflatable floatable unit according to claim 1, wherein the gangway element extends between the top of a seating element and the top of the inflatable outer tube.

15. The inflatable floatable unit according to claim 1, wherein the width of a gangway element and/or the number of gangway elements can be changed during operation of the inflatable floatable unit.

16. The inflatable floatable unit according to claim 1, wherein the inflatable floatable unit comprises multiple gangway elements extending in the same or multiple directions across and along the inflatable seating elements.

17. The inflatable floatable unit according to claim 16, wherein at least two gangway elements are arranged, the two gangway elements being positioned across the seating elements so that the protected area is divided into three areas having substantially the same size.

18. The inflatable floatable unit according to claim 1, further comprising a first inflation system for inflating the inflatable flotation layer and a second inflation system for inflating the inflatable seating elements.

19. The inflatable floatable unit according to claim 18, further comprising at least one on-board compressor constituting part of the first and/or the second inflation system.

20. An evacuation system comprising at least one inflatable floatable unit according to claim 1 and one or more chutes and/or slides extending from a vessel to the at least one inflatable floatable unit.

21. The evacuation system according to claim 20, comprising two inflatable floatable units positioned side by side and being releasably connected with each other.

22. The evacuation system according to claim 21, wherein the gangway extends from a side of one of the inflatable floatable units across both inflatable floatable units to a side of the other inflatable floatable unit.

23. A vessel comprising an evacuation system according to claim 20.

* * * * *